US005685539A

United States Patent [19]

Janatka et al.

[11] Patent Number: 5,685,539

[45] Date of Patent: Nov. 11, 1997

[54] DISK TRANSPORT FOR PAPER SHEETS

[75] Inventors: Karel J. Janatka, Southbury; William J. Wright, Killingworth, both of Conn.

[73] Assignee: Pitney Bowes Inc., Stamford, Conn.

[21] Appl. No.: 498,308

[22] Filed: Jul. 5, 1995

[51] Int. Cl.[6] ..... B65H 5/02

[52] U.S. Cl. ..... 271/273; 271/275; 198/836.1

[58] Field of Search ..... 271/272, 273, 271/275, 198, 216; 198/836.1, 836.3

[56] References Cited

U.S. PATENT DOCUMENTS

| | | | |
|---|---|---|---|
| 2,274,075 | 2/1942 | Borrbard | 271/216 |
| 3,019,014 | 1/1962 | Miksis | 271/272 |
| 3,700,232 | 10/1972 | Wiegert et al. | 271/216 |
| 3,951,402 | 4/1976 | Skinner | 271/273 |
| 4,241,910 | 12/1980 | Matsuo et al. | 271/216 |
| 5,054,767 | 10/1991 | Gammerler | 271/272 |
| 5,431,389 | 7/1995 | Wensink et al. | 271/273 |

FOREIGN PATENT DOCUMENTS

| | | | |
|---|---|---|---|
| 0225749 | 10/1986 | Japan | 271/272 |

*Primary Examiner*—H. Grant Skaggs

*Attorney, Agent, or Firm*—Christopher J. Capelli; Robert H. Whisker; Melvin J. Scolnick

[57] ABSTRACT

Apparatus for transporting sheets of paper seriatim. The apparatus includes: a pair of parallel, rotatable, endless, flat belts having upper and lower reaches disposed substantially horizontally; a pair of supporting beams situated above the upper reaches of the pair of endless belts; a plurality of unbiased rollers seated in each of the supporting beams and resting on the flat belts with only their own weight; and a device for rotating the flat belts to thereby cause the sheets of paper to move with the upper reaches of the belts and the unbiased rollers, wherein the sheets of paper are caused to move entirely parallel to the belts without any skew caused by the unbiased rollers.

4 Claims, 3 Drawing Sheets

DISK TRANSPORT FOR PAPER SHEETS

BACKGROUND OF THE INVENTION

The instant invention relates to apparatus for transposing sheets of paper and more particularly to sheet transposing apparatus for use in inserting systems where it is imperative that straight alignment of the sheets be maintained.

In virtually all paper handling systems, there is a need to feed the paper sheets from an upstream unit straight into a downstream unit. For example, in an inserting system in which folded sheets of paper are ultimately inserted into a waiting envelope, it is imperative that sheets of paper entering a buckle chute folder be straight prior to entering the buckle chute folder. Those sheets of paper which fail to enter the folder straight cannot be folded properly and ultimately cause problems at the envelope insertion station, which can cause the entire system to have to be shut down.

In order to maintain sheets of paper being transported in a straight path, the prior art has relied on various devices. A common means of maintaining sheets straight in the course of transport is the use of a registration edge on the side of the transport path. Such registration edges typically require rollers or some other drive means to steer the paper sheets toward the registration edge and thus are complex and costly. Another means of maintaining sheets straight in the course of transport involves the use of steel or plastic balls located above a transport belt and the cooperation of the balls with the belt helps to maintain the sheets in a straight path. In many cases the steel or plastic balls are biased toward the belt with spring pressure, and even in those cases where there is no bias, there is usually enough variation in the ball devices, such as variations in mounting, to cause undesired steering of the sheets in the course of transport.

The instant invention thus provides apparatus which is capable of transporting sheets of paper in a straight line without any steering of the paper as it exits upstream apparatus and is conveyed to downstream apparatus.

SUMMARY OF THE INVENTION

Accordingly, the instant invention provides apparatus for transporting sheets of paper seriatim. The apparatus includes: a pair of parallel, rotatable, endless, flat belts having upper and lower reaches disposed substantially horizontally; a pair of supporting beams situated above the upper reaches of the pair of endless belts; a plurality of unbiased rollers seated in each of the supporting beams and resting on the flat belts with only their own weight; and means for rotating the flat belts to thereby cause the sheets of paper to move with the upper reaches of the belts and the unbiased rollers, wherein the sheets of paper are caused to move entirely parallel to the belts without any skew caused by the unbiased rollers.

DETAILED DESCRIPTION OF THE PREFERRED EMBODIMENT

Figure 1:
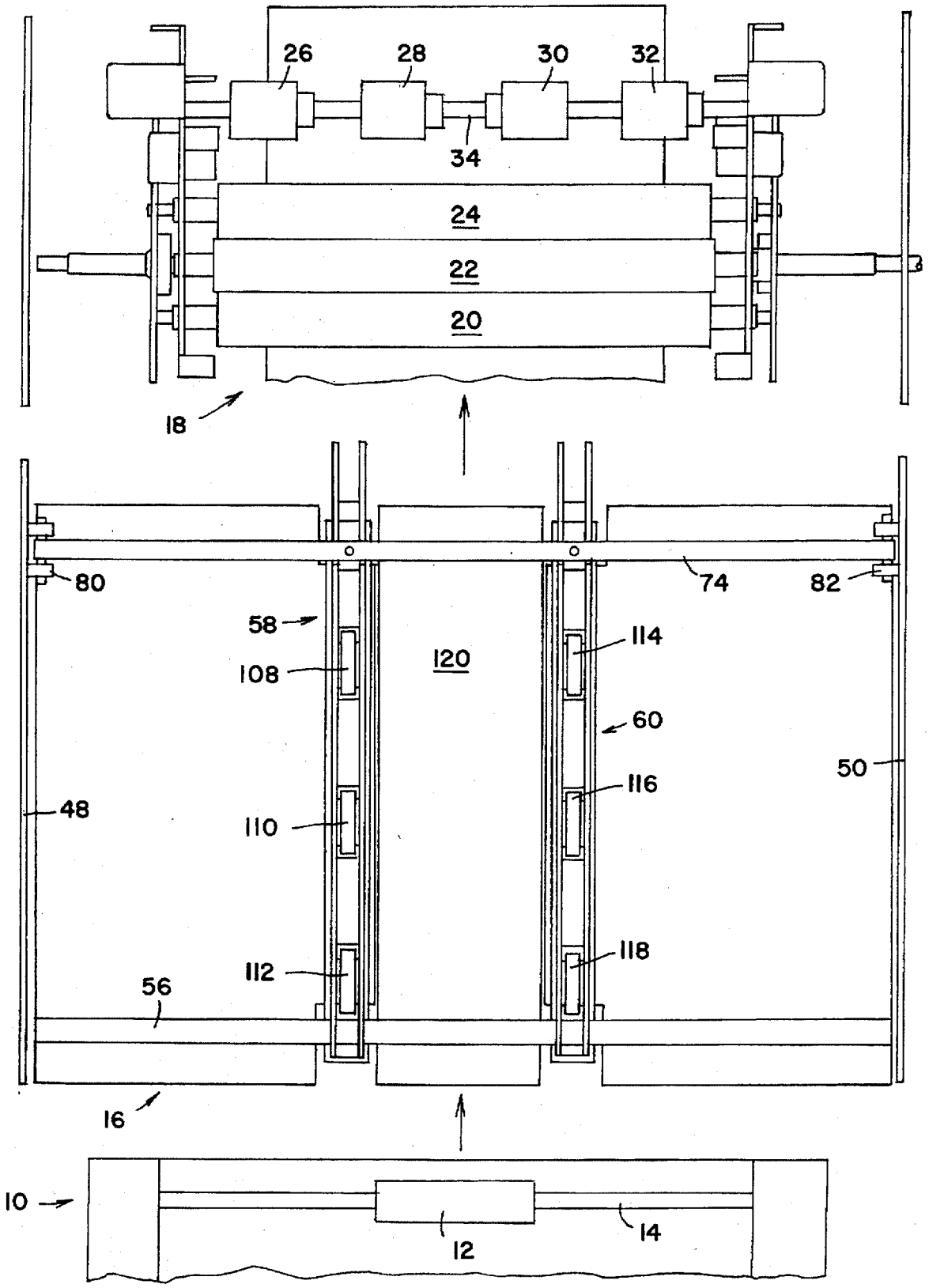
FIG. 1 is a top, plan view of a sheet feeder, a paper transport in accordance with the instant invention, and a buckle chute folder.

In describing the preferred embodiment of the instant invention, reference is made to the drawings, wherein there is seen a sheet feeder generally designated 10 having a feed roller 12 mounted on a shaft 14 for feeding seriatim sheets of paper (not shown) received from upstream apparatus (not shown) toward a paper transport 16. The paper sheets are conveyed from the transport 16 into a buckle chute folder generally designated 18 which includes a buckle chute (not shown) and folding rollers 20, 22 and 24 for implementing the folds in conventional manner. The paper sheets are urged out of the folder 18 by segmented take-away rollers 26, 28, 30 and 32 mounted on a shaft 34.

Figure 2:
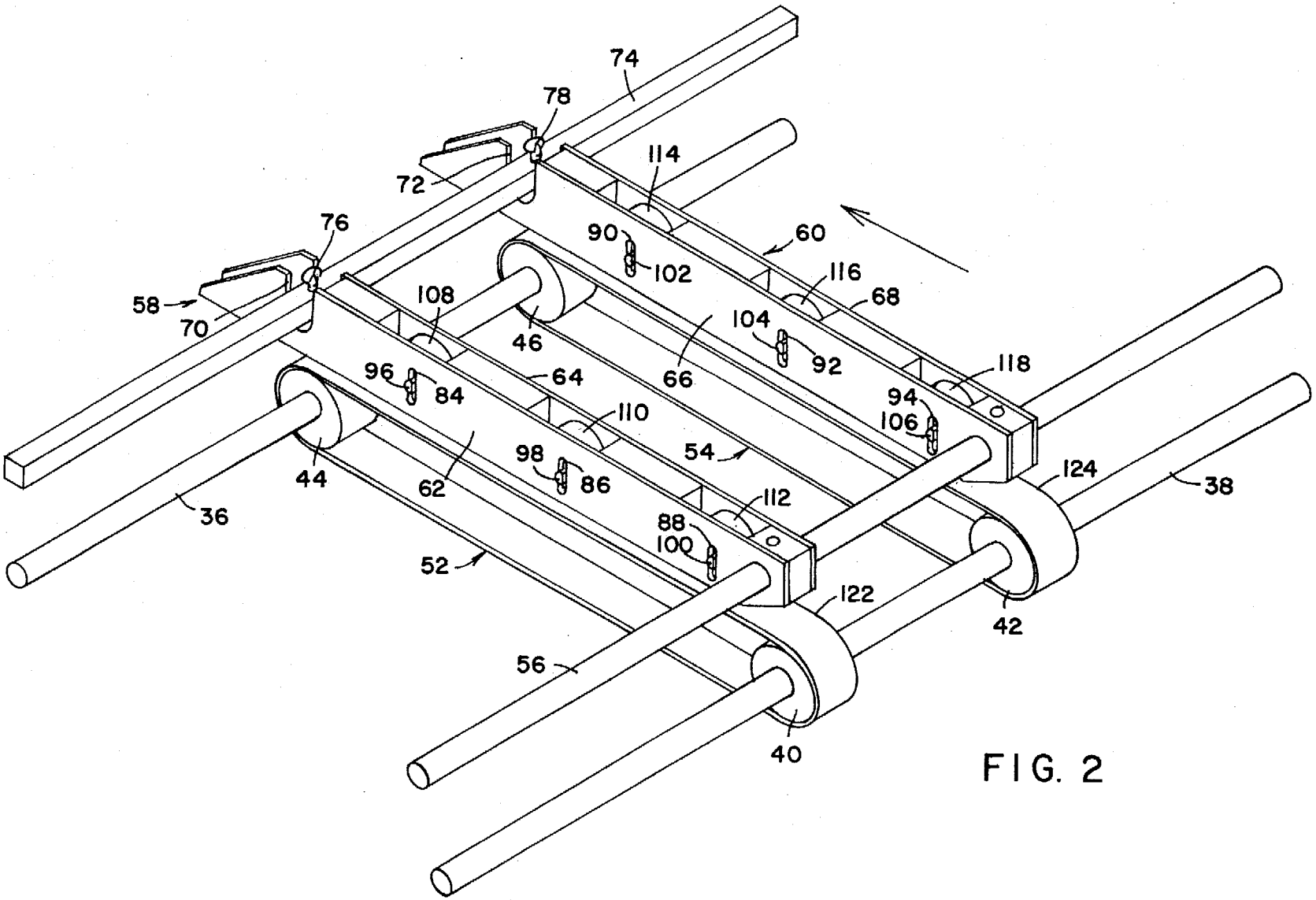
FIG. 2 is a perspective view of the paper transport seen in FIG. 1.
Figure 3:
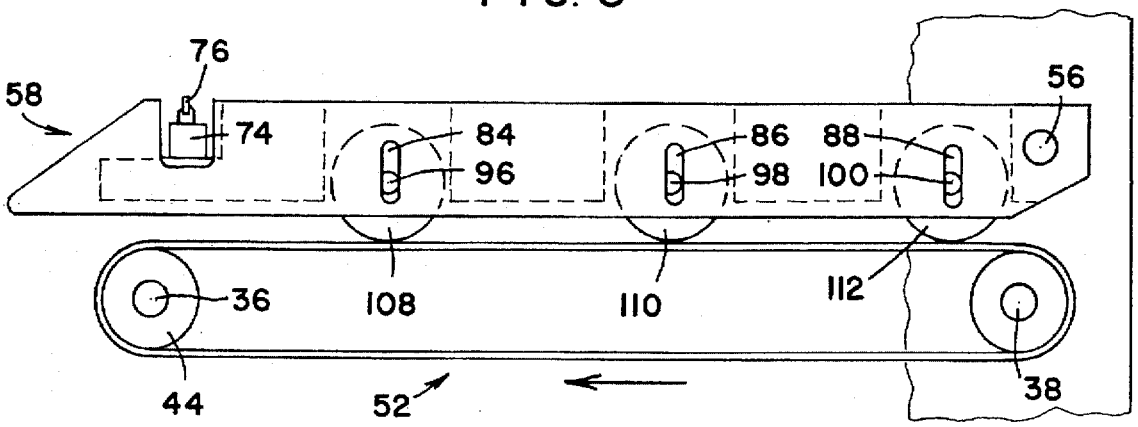
FIG. 3 is a side, elevation view of the paper transport seen in FIG. 2.
Figure 4:
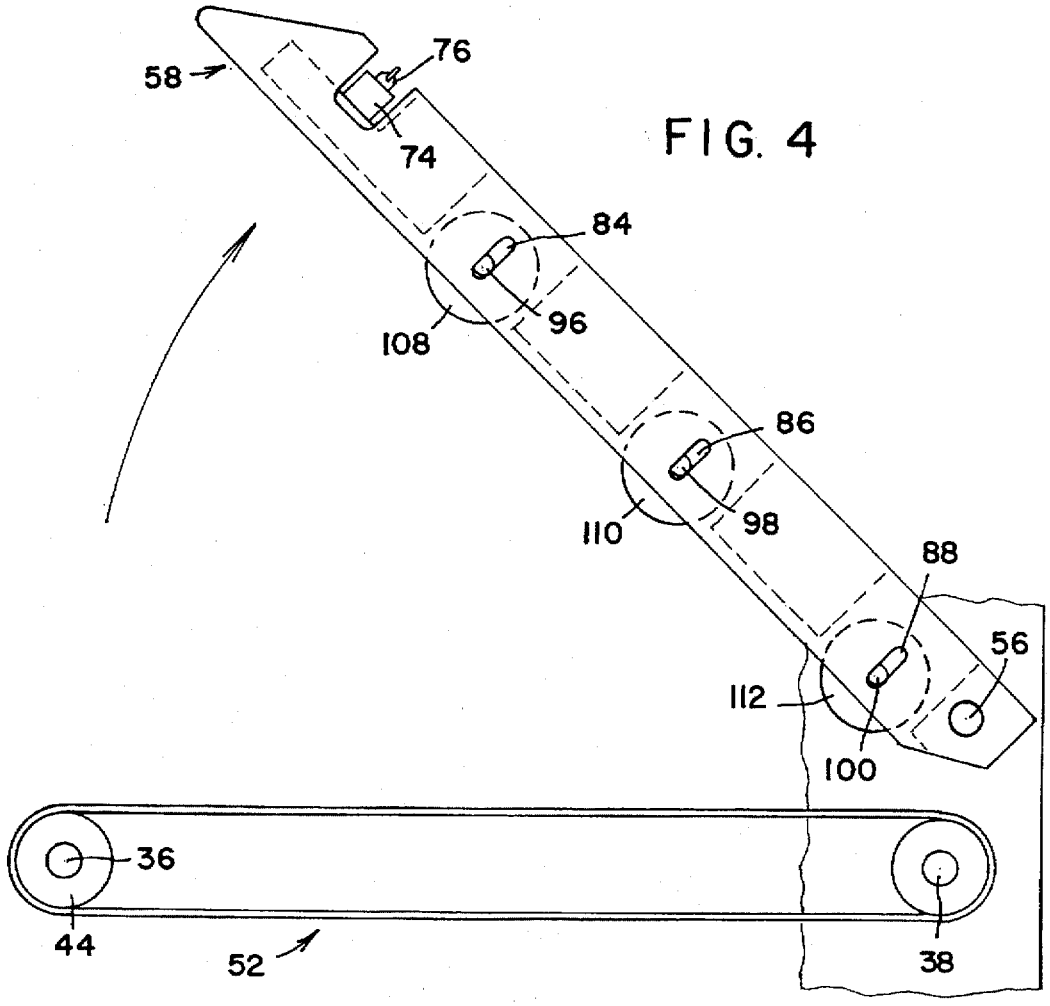
FIG. 4 is similar to FIG. 3 but shows the paper transport in the open position for jam clearance.

In describing the paper transport 16, reference is now made to FIGS. 2–4, wherein the transport 16 is seen to include a drive shaft 36 and a driven shaft 38 upstream of the drive shaft 36. A pair of downstream pulleys 40 and 42 are rotatably mounted on the driven shaft 38. A pair of upstream pulleys 44 and 46 are fixedly secured to the drive shaft 36. The shafts 36 and 38 are suitably mounted in the side frames 48 and 50 (see FIG. 1) of the transport 16. A first flat belt 52 is mounted on the pulleys 40 and 44 and a second flat belt 54 is mounted on the pulleys 42 and 46.

Located above the driven shaft 38 is a fixed shaft 56 which is journalled in the side frames 48 and 50. A pair of longitudinally extending frame members 58 and 60 are pivotably mounted at their downstream ends on the fixed shaft 56. Each of the frame members 58 and 60 includes a pair of side walls 62 and 64 and 66 and 68 respectively. The downstream ends of the frames 58 and 60 include notches 70 and 72 respectively which engage a rectangular bar 74 which is fixedly secured to the frames 58 and 60 by means of screws 76 and 78. The bar 74 has a snap fit engagement with a pair of brackets 80 and 82 (see FIG. 1) which are mounted on the side frames 48 and 50 respectively.

The side wall 62 includes three vertically extending slots 84, 86 and 88. The side wall 64 similarly contains three vertically extending slots (not shown) which are oppositely aligned to the slots 84, 86 and 88 in the side wall 62. The side wall 66 also includes three vertically extending slots 90, 92 and 94 and, similarly, the side wall 68 contains three vertically extending slots (not shown) which are oppositely aligned to the slots 90, 92 and 94. Each of the slots 84, 86 and 88 and its oppositely aligned slot in the wall 64 slidingly engages a shaft 96, 98 and 100 respectively. Likewise, each of the slots 90, 92 and 94 and its oppositely aligned slot in the wall 68 slidingly engages a shaft 102, 104 and 106 respectively. Each of the shafts 96, 98, 100, 102, 104 and 106 includes a roller disk 108, 110, 112, 114, 116 and 118 respectively mounted thereon.

As best seen in FIG. 1, the paper transport 16 includes a deck 120 for supporting the paper sheets to be transported by the paper transport 16. The upper reaches 122 and 124 of the belts 52 and 54 respectively lie across the deck 120 and are supported thereby. The roller disks 108, 110, 112, 114, 116 and 118, in a preferred embodiment, include a knurled, peripheral surface for more positive engagement with the paper sheets being transported. None of the roller disks is biased downwardly with anything except its own weight.

FIG. 3 shows the normal, operating position of the paper transport 16, but FIG. 4 shows the frame members 58 and 60 pivoted upward and counter-clockwise about the shaft 56 in the event that paper becomes jammed in the transport 16. In order to move the frame members 58 and 60 to the position seen in FIG. 4, it is merely necessary for an operator to grasp the bar 74 and pull upwardly to break the snap fit engagement between the bar 74 and the brackets 80 and 82.

From the foregoing description, it can be seen that roller disks 108, 110, 112, 114, 116 and 118 effect linear contact with the flat belts 122 and 124 and paper sheets whenever they are being conveyed by the belts 122 and 124. Because there is no bias on the aforesaid roller disks, and because the said disks effectuate linear contact with the paper sheets being fed, there is no steering of the sheets across the transport 16, and thus the sheets are able to enter the downstream folder 18, or any other suitable paper processing apparatus, straight without the need for any side registration device.

It should be understood by those skilled in the art that various modifications may be made in the present invention without departing from the spirit and scope thereof, as described in the specification and defined in the appended claims.

What is claimed is:

1. Apparatus for transporting sheets of paper seriatim, comprising:

a pair of parallel side frames spaced apart from one another;

a pair of parallel, rotatable, endless, flat belts having upper and lower reaches disposed substantially horizontally and between said pair of parallel side frames;

a pair of supporting beams situated above said upper reaches of said pair of endless belts, each said supporting beam having an upstream end and an opposing downstream end and each said supporting beam defining a plurality of pairs of vertically extending through slots;

an elongate locking bar fixed to each said downstream end of each said supporting beam wherein said locking bar extends perpendicular relative to said supporting beams, said locking bar having opposing ends configured for a snap fit locking arrangement with said pair of parallel side frames;

an elongate pivoting shaft fixed to each said upstream end of each said supporting beam wherein said pivoting shaft extends perpendicular relative to said supporting beams, said pivoting shaft having opposing ends respectively pivotably mounted in said pair of parallel side frames;

a plurality of unbiased disk shaped rollers seated in each of said supporting beams and resting on said flat belts with only their own weight, wherein each said disk shaped roller includes a fixed shaft extending therethrough, which shaft extends through a said respective pair of vertically extending through slots; and means for rotating said flat belts to thereby cause said sheets of paper to move with the upper reaches of said belts and said unbiased rollers, wherein said sheets of paper are caused to move entirely parallel to said belts without any skew caused by said unbiased rollers.

2. The apparatus of claim 1, wherein the peripheral surfaces of said unbiased rollers are knurled.

3. The apparatus of claim 2, additionally comprising a paper transport deck between said supporting beams and said endless, flat belts.

4. The apparatus of claim 3, wherein the lower surfaces of the upper reaches of said belts engage said paper transport deck.

* * * * *